YARN TEXTURING

This invention relates to the texturing of yarns by false twist crimping. According to the present invention there is provided a texturing process in which a yarn advances through one or more heat transfer zones to a false twisting means wherein heat is transferred to and/or from the yarn by a transverse fluid flow which also supports the yarn in a curved path.

The preferred fluid is air though other gaseous mixtures or single gases may be employed including steam.

In particular the yarn may be cooled by a transverse fluid flow.

The curved path may comprise an arc so that the yarn direction after the curved path is different from the yarn direction before the curved path. Alternatively the curved path may conveniently take the form of a 360° loop so that the yarn leaves the curved path travelling in the same direction as that in which it entered the curved path. Depending upon the relative positions of heating and/or false twisting means other shapes of curved path may also be used such as, for example, an arc in one direction of curvature followed by an arc in another direction of curvature, or a succession of such alternating arcs providing other 2 or 3-dimensional sinuous yarn paths.

If the logarithm of the difference between the yarn temperature and the ambient air temperature at a point in the cooling zone is plotted against the distance along the yarn path from the end of the heating zone, then a roughly straight line is usually obtained with a slope of $-k/v$ where $v$ is the yarn velocity and $k$ is the cooling rate. It is found that in a process according to the invention the cooling rate is greater and more consistent between different yarns, and that the yarns are more stable and yield a more uniform textured yarn product than in processes in which no air guide is used to assist in yarn cooling before the false twisting means.

The following examples illustrate but do not limit the present invention.

Examples 1–16

A 250 decitex 45 filament polyester yarn derived from polyethylene terephthalate was passed at 440 meters per minute over a 1.8 meter flat plate with a surface temperature of 250°C to a false twister, and the following tables (I and II) gives some results from 16 experiments under different cooling conditions. Experiments 1–4 and 13–16 are examples of the invention, while 5–12 are comparative examples. In each of the examples of the invention a circular air guide was used providing a yarn path loop of 360° at a diameter of about 9.5 cm in a continuous slot 0.0038 cm wide. An air flow of 220 liters per minute was provided at the slot and this was sufficient the cushion the yarn in its circular path so that it did not come into contact with any solid guiding surfaces.

In example 5 an unheated aluminium cooling plte 0.97 meters long was used to stabilise and support the yarn. In examples 6, 7 and 8 no such stabilising plate was used and the yarn vibrated between the heater and the false twister. Under these vibrating conditions the cooling rate in ambient air was higher but less consistent. In examples 1–5 the cooling rate in the air guide was both very high and very consistent, and the yarn was quite stable so the cooling rate in the ambient air before and after the guide, unassisted by a cooling plate, was quite low. It is common to use a second heater to stabilise the yarn after crimping. Table II shows that the resultant yarn shrinkage is much less dependent on primary and secondary heater temperatures when there is efficient cooling by an air guide before the false twister.

TABLE I

EFFECT OF REDUCING COOLING DISTANCE

| Example No. | 1 | 2 | 3 | 4 | 5 | 6 | 7 | 8 |
|---|---|---|---|---|---|---|---|---|
| Cooling Distances: | | | | | | | | |
| Heater to twister, meters | 1.23 | 0.97 | 0.77 | 0.50 | 1.23 | 1.23 | 0.90 | 0.76 |
| Heater to air guide, m | 0.97 | 0.70 | 0.40 | 0.22 | — | — | — | — |
| Air guide circumference, m | 0.31 | 0.31 | 0.31 | 0.31 | — | — | — | — |
| Air guide to twister, m | 0.21 | 0.21 | 0.21 | 0.21 | — | — | — | — |
| Total cooling length, m | 1.49 | 1.22 | 0.92 | 0.74 | 1.23 | 1.23 | 0.90 | 0.76 |
| Yarn Temperatures: | | | | | | | | |
| Leaving heater °C | 248 | 249 | 247 | 247 | 233 | 240 | 230 | 236 |
| Entering air guide °C | 173 | 181 | 214 | 226 | — | — | — | — |
| Leaving air guide °C | 49 | 51 | 60 | 62 | — | — | — | — |
| Entering twister °C | 46 | 47 | 57 | 58 | 102 | 68 | 86 | 121 |
| k in air guide °C/°C/min | 1020 | 1010 | 960 | 970 | — | — | — | — |
| k in ambient air °C/°C/min | 79 | 96 | 75 | 86 | 180 | 250 | 246 | 191 |

TABLE II

EFFECT OF REDUCING TEMPERATURES

| Example No. | 9 | 10 | 11 | 12 | 13 | 14 | 15 | 16 |
|---|---|---|---|---|---|---|---|---|
| Temperatures: | | | | | | | | |
| Crimp setting heater (primary) °C | 240 | 235 | 230 | 225 | 225 | 230 | 235 | 240 |
| Post crimp stabilising heater (secondary) °C | 195 | 190 | 185 | 180 | 180 | 185 | 190 | 195 |
| Cooling Rates: | | | | | | | | |
| k in air guide °C/°C/min | — | — | — | — | 1070 | 1030 | 1020 | 1040 |
| k in ambient air °C/°C/min | 209 | 180 | 168 | 168 | 63 | 76 | 72 | 82 |
| Yarn shrinkages % | 15.5 | 16.7 | 21.4 | 22.9 | 14.0 | 14.0 | 12.5 | 12.6 |

United States Patent [19]

Roden et al.

[11] 3,958,407

[45] May 25, 1976

[54] YARN TEXTURING

[75] Inventors: Martin Joseph Roden; Frederick William Shaw, both of Harrogate, England

[73] Assignee: Imperial Chemical Industries Limited, London, England

[22] Filed: Aug. 22, 1974

[21] Appl. No.: 500,004

[30] Foreign Application Priority Data

Aug. 28, 1973 United Kingdom ..... 40524/73

[52] U.S. Cl. ..... 57/157 TS; 57/34 HS; 57/106

[51] Int. Cl.[2] ..... D01H 13/28

[58] Field of Search ..... 57/34 HS, 34 R, 34 B, 57/106, 157 R, 157 TS, 157 MS; 28/62

[56] References Cited

UNITED STATES PATENTS

| | | | |
|---|---|---|---|
| 3,113,366 | 12/1963 | Taylor | 57/34 HS UX |
| 3,368,335 | 2/1968 | Horvath | 57/34 HS |
| 3,407,585 | 10/1968 | Hilbert | 57/106 X |
| 3,478,401 | 11/1969 | Whitworth et al. | 28/62 |
| 3,641,756 | 2/1972 | Keith et al. | 57/34 HS |
| 3,698,177 | 10/1972 | Nyfeler | 57/157 TS X |
| 3,861,129 | 1/1975 | Doschko | 57/34 HS |

FOREIGN PATENTS OR APPLICATIONS

| | | | |
|---|---|---|---|
| 1,245,023 | 9/1971 | United Kingdom | 57/34 HS |

*Primary Examiner*—Donald E. Watkins
*Attorney, Agent, or Firm*—Cushman, Darby & Cushman

[57] ABSTRACT

A yarn texturing process wherein the yarn is false twisted and heat set and wherein the yarn is passed through an elongated heat transfer means and is supported therein on a cushion of fluid flowing in the heat transfer means.

9 Claims, No Drawings

TABLE V -continued

| Ex. | Heater Type | Air Flow cu ft/min | Indicated Heater Temp. °C | Yarn Temp Entry to Heater °C | Yarn Temp Leaving Heater °C | Path length in Heater cm | Heating rate k* °C/°C/min | REMARKS |
|---|---|---|---|---|---|---|---|---|
| C | Linear air guide 0.018 cm slot width 20 cm length | 9 | 140 | 72 | 116 | 20.3 | 940 | Used with feed roll at 118°C. D/R speed 580 m/min |
| D | Linear air guide 0.018 cm slot width 20 cm length | 9 | 205 | 62 | 134 | 20.3 | 865 | Used with feed roll at 118°C. D/R speed 580 m/min |
| E | V-shaped air guide 0.0038 cm slot width 20 cm length | 8 | 205 | 62 | 136 | 20.3 | 910 | Used with feed roll at 118°C. D/R speed 580 m/min |
| F | V-shaped air guide 0.0038 cm slot width 20 cm length | 8 | 205 | 23 | 155 | 20.3 | 940 | No other heating means used. D/R speed 340 m/min |
| G | 1.8 meter Flat plate heater | — | 200 | 23 | 190 | 1.8m | 400 | Control. D/R speed 580 m/min |
| H | 1.8 meter Flat plate heater | — | 200 | 23 | 185 | 1.8m | 346 | Conrol. D/R speed 580 m/min |

*Calculated as above but where the logarithm of the difference between the heater temperature and the yarn exit temperature is plotted against the length of the heater.

Preferably the yarn is both heated and cooled while being supported in curved paths by fluids flowing transversely to the yarn.

We claim:

1. A yarn texturing process in which yarn advances from twist setting means to false twisting means wherein the improvement comprises passing the yarn through a continuous elongated slot in heat transfer means positioned between the twist setting and false twisting means where the yarn is cooled by a transverse fluid flow which also supports the yarn in a curved path within the slot.

2. A process according to claim 1 wherein the yarn is both heated and cooled by a transverse fluid flow.

3. A process according to claim 1 wherein the curved path comprises one or more arcs so that the yarn direction after the curved path is different from the yarn direction before the curved path.

4. A process according to claim 3 wherein the yarn direction remains unchanged.

5. A process according to claim 1 wherein the yarn is derived from a polyester.

6. A process according to one claim 1 wherein the yarn is derived from a polyamide.

7. A process according to claim 5 wherein the yarn is drawn prior to being textured.

8. A process according to claim 7 wherein the yarn is sequentially drawn and textured.

9. A process according to claim 5 wherein the yarn is simultaneously drawn and textured.

* * * * *